US008593099B2

(12) United States Patent
Shibuya et al.

(10) Patent No.: US 8,593,099 B2
(45) Date of Patent: Nov. 26, 2013

(54) ELECTRIC COMPRESSOR

(75) Inventors: Makoto Shibuya, Isesaki (JP); Atsushi Saito, Isesaki (JP)

(73) Assignee: Sanden Corporation, Isesaki-shi (JP)

( * ) Notice: Subject to any disclaimer, the term of this patent is extended or adjusted under 35 U.S.C. 154(b) by 313 days.

(21) Appl. No.: 12/994,659

(22) PCT Filed: Apr. 28, 2009

(86) PCT No.: PCT/JP2009/058367
§ 371 (c)(1),
(2), (4) Date: Nov. 24, 2010

(87) PCT Pub. No.: WO2009/145028
PCT Pub. Date: Dec. 3, 2009

(65) Prior Publication Data

US 2011/0089881 A1 Apr. 21, 2011

(30) Foreign Application Priority Data

May 28, 2008 (JP) ..... 2008-139833

(51) Int. Cl.
*G05B 11/28* (2006.01)

(52) U.S. Cl.
USPC ..... 318/599; 318/811; 318/461

(58) Field of Classification Search
USPC ..... 318/599, 811, 461; 388/800, 811, 815, 388/819, 934
See application file for complete search history.

(56) References Cited

U.S. PATENT DOCUMENTS

| | | | | |
|---|---|---|---|---|
| 5,170,636 | A * | 12/1992 | Hitosugi | 62/175 |
| 5,297,395 | A * | 3/1994 | Ozu et al. | 62/174 |
| 5,996,360 | A * | 12/1999 | Tanaka et al. | 62/160 |
| 6,321,563 | B1 | 11/2001 | Ikeda et al. | |
| 6,564,576 | B2 * | 5/2003 | Shibuya | 62/505 |
| 7,122,928 | B2 * | 10/2006 | Shindo | 310/89 |
| 2006/0222511 | A1 * | 10/2006 | Nishikawa et al. | 417/213 |

FOREIGN PATENT DOCUMENTS

| | | |
|---|---|---|
| JP | 2000-291557 | 10/2000 |
| JP | 2003-139069 | 5/2003 |

OTHER PUBLICATIONS

Computer generated translation of Japanese patent JP 2003-139069, 6 pages, Dec. 28, 2012.*
International Search Report issued in International App. No. PCT/JP2009/058367, mailed Jul. 14, 2009.

* cited by examiner

*Primary Examiner* — Rina Duda
(74) *Attorney, Agent, or Firm* — Greer, Burns & Crain, Ltd.

(57) ABSTRACT

Provided is an electric compressor whose manufacturing cost is reduced and in which a motor driving circuit can be positively protected. A temperature sensor is provided in the vicinity of a power semiconductor element whose temperature becomes highest among a plurality of power semiconductor elements and control of the number of revolutions of a motor is performed on the basis of temperatures detected by the temperature sensor, whereby it is possible to change the number of revolutions of the motor by using a temperature in the vicinity of a power semiconductor element in a position under the worst temperature conditions as a reference, and it becomes possible to positively protect an inverter circuit without the need for a plurality of temperature sensors.

4 Claims, 2 Drawing Sheets

ELECTRIC COMPRESSOR

This application is a U.S. National Phase under 35 U.S.C. §371 of International Application No. PCT/JP2009/058367Apr. 28, 2009.

TECHNICAL FIELD

The present invention relates to an electric compressor in which a driving circuit of a motor is housed in a housing.

BACKGROUND ART

As an electric compressor of this kind, there has hitherto been used an electric compressor which is provided with a compression section for compressing a cooling medium sucked in a housing, a motor for driving the compression section, a motor driving circuit for driving a motor which has a plurality of heat generating parts, and a partition wall which is provided so as to partition the cooling medium suction chamber provided on the cooling medium inflow side in the housing and a driving circuit housing chamber in which the motor driving circuit is housed and permits heat exchange between the cooling medium in the cooling medium suction chamber and the motor driving circuit in the driving circuit housing chamber (refer to Patent Literature 1, for example).

In the above-described electric compressor, it is ensured that the motor driving circuit is cooled by a cooling medium via the partition in order to prevent troubles and breakdowns of the motor driving circuit due to the heat generated by the heat generating parts. Also, it is ensured that troubles and breakdowns of the motor driving circuit are prevented by controlling the number of revolutions of the motor on the basis of temperatures detected by a temperature sensor, such as a thermistor, which is provided to detect the temperature of the motor driving circuit.

PRIOR ART DOCUMENT

Patent Document

Patent Document 1: Japanese Patent Publication 2003-139069

SUMMARY OF THE INVENTION

Problems to be Solved by the Invention

In the above-described electric compressor, there is a case where the motor driving circuit cannot be provided in the range of the partition wall due to a limited installation space of the motor driving circuit and there is a case where the temperature of the partition wall is not uniform. In such cases, to protect the motor driving circuit, it is necessary to control the number of revolutions of the motor by using a temperature sensor in each of the heat generating parts, resulting in high manufacturing cost.

The object of the present invention is to provide an electric compressor whose manufacturing cost is reduced and in which a motor driving circuit can be positively protected.

Means for Solving The Problem

To achieve the above-described object, the present invention provides an electric compressor which includes: a compression section for compressing a cooling medium sucked into a housing; a motor for driving the compression section; a motor driving circuit for driving the motor which has a plurality of heat generating parts; a cooling medium suction chamber provided on the cooling medium inflow side in the housing; a driving circuit housing chamber for housing the motor driving circuit; a partition wall which is provided so as to partition the cooling medium suction chamber and the driving circuit housing chamber, and permits heat exchange between the cooling medium in the cooling medium suction chamber and the motor driving circuit in the driving circuit housing chamber; a temperature sensor provided in the vicinity of a heat generating part whose temperature becomes highest among a plurality of heat generating parts; and a control section for performing control of the number of revolutions of the motor on the basis of detected temperatures of the temperature sensor.

As a result of this, because temperatures in the vicinity of a heat generating part whose temperature is highest among a plurality of heat generating parts are detected, control of the number of revolutions of the motor is performed by using temperatures in the vicinity of the heat generating part in a position under the worst temperature conditions as a reference.

Also, to achieve the above-described object, the present invention provides an electric compressor which includes: a compression section for compressing a cooling medium sucked into a housing; a motor for driving the compression section; a motor driving circuit for driving the motor which has a plurality of heat generating parts; a cooling medium suction chamber provided on the cooling medium inflow side in the housing; a driving circuit housing chamber for housing the motor driving circuit; a partition wall which is provided so as to partition the cooling medium suction chamber and the driving circuit housing chamber, and permits heat exchange between the cooling medium in the cooling medium suction chamber and the motor driving circuit in the driving circuit housing chamber; a temperature sensor provided in the vicinity of a heat generating part whose distance from the partition wall is longest among a plurality of heat generating parts; and a control section for performing control of the number of revolutions of the motor on the basis of detected temperatures of the temperature sensor.

As a result of this, because temperatures in the vicinity of a heat generating part whose distance from the partition wall is longest among a plurality of heat generating parts are detected, control of the number of revolutions of the motor is performed by using temperatures in the vicinity of the heat generating part in a position under the worst temperature conditions as a reference.

Effects of The Invention

According to the present invention, because control of the number of revolutions of the motor can be performed by using only temperatures in the vicinity of a heat generating part in a position under the worst temperature conditions as a reference, it becomes possible to positively protect the motor driving circuit without the need for a plurality of temperature sensors.

PREFERRED EMBODIMENT OF THE INVENTION

Figure 1:
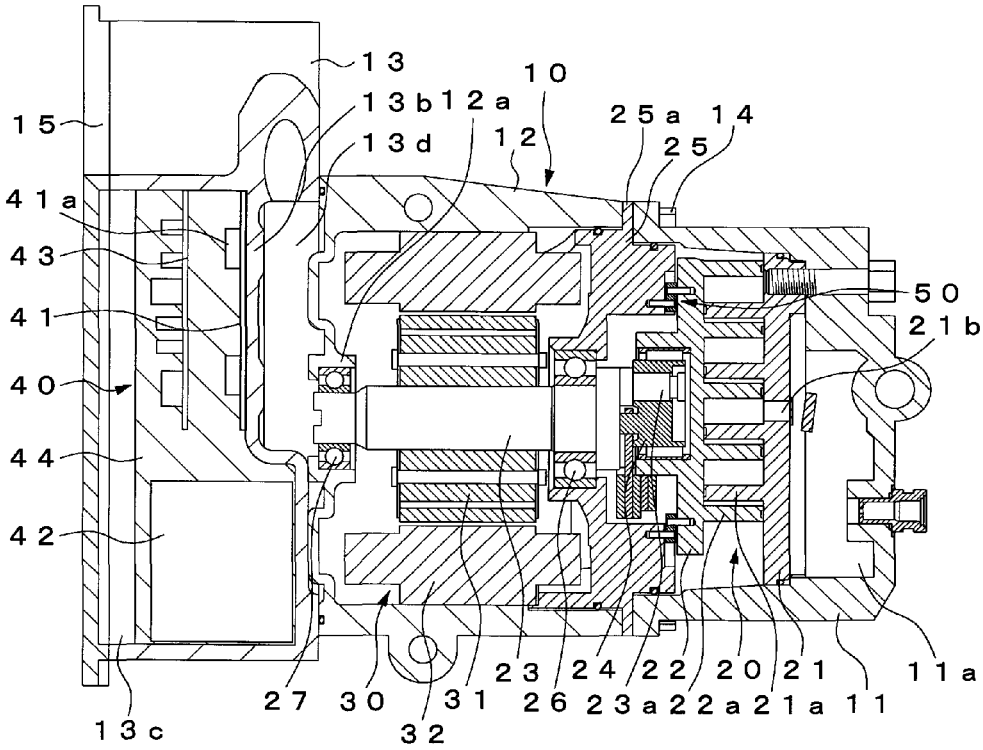
FIG. 1 is a side sectional view of an electric compressor showing an embodiment of the present invention.
Figure 2:
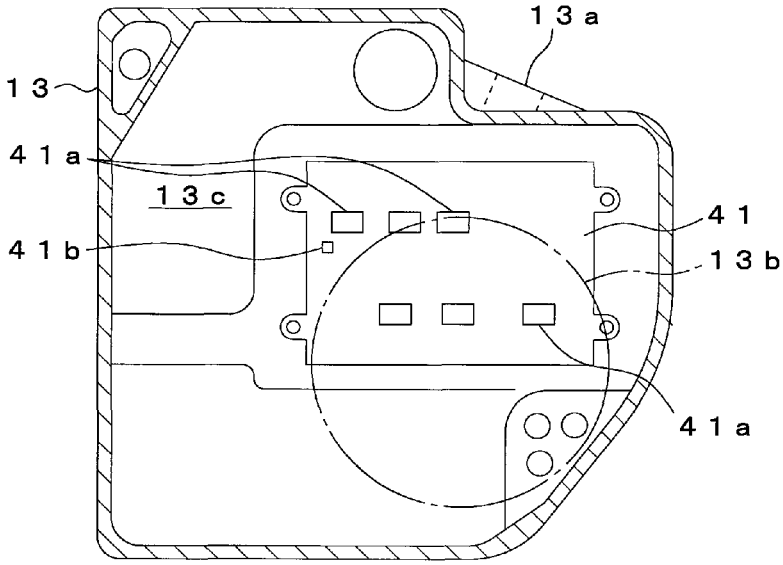
FIG. 2 is a diagram showing a driving circuit housing chamber.
Figure 3:
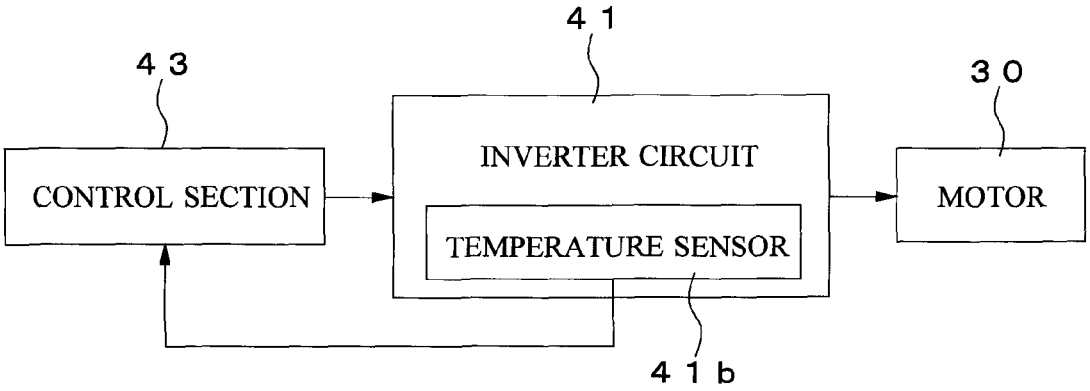
FIG. 3 is a block diagram showing a control system.

FIGS. 1 to 3 show an embodiment of the present invention.

The electric compressor of the present invention is a scroll-type electric compressor which is provided with a housing 10 formed in cylindrical shape, a compression section 20 for compressing a cooling medium, a motor 30 for driving the compression section 20, and a driving circuit section 40 as a motor driving circuit for performing operation control of the motor 30. In this electric compressor, for example, HFC-134a, carbon dioxide and the like are used as a cooling medium.

The housing 10 is composed of a first housing 11 in which the compression section 20 is housed, a second housing 12 in which the motor 30 is housed, and a third housing 13 in which the driving circuit section 40 is housed.

The first housing 11 is such that one end surface thereof is closed and the other end surface thereof is joined to one end surface of the second housing 12. A cooling medium discharge port, which is not shown, is provided on a peripheral surface on the side of the one end surface.

The second housing 12 is such that one end surface thereof is joined to the first housing 11 and the other end surface thereof is joined to one end surface of the third housing 13.

The first housing 11 and the second housing 12 are joined together by a bolt 14 via a center plate, which will be described later, for rotatably supporting the side of one end of a driving shaft, which will be described later, for driving the compression section 20.

The third housing 13 is such that the side of one end surface thereof is joined to the second housing 12 and the side of the other end surface thereof is closed by a closing plate 15 so as to be openable. A cooling medium suction port 13*a* is provided on a peripheral surface on the side of one end surface of the third housing 13. Furthermore, the third housing 13 is such that the interior thereof is partitioned by a partition wall 13*b* into the side of one end surface including the cooling medium suction port 13*a* and the side of the other end surface, and the third housing 13 is provided with a driving circuit housing chamber 13*c* for housing the driving circuit section 40 and a cooling medium suction chamber 13*d* in communication with the motor 30 side. Incidentally, in FIG. 2 showing the driving circuit housing chamber 13*c*, the range of the partition wall 13*b* is indicated by an alternate long and short dash line.

The compression section 20 has a fixed scroll member 21 fixed to the side of one end of the first housing 11 and a rotating scroll member 22 provided on the side of the other end of the first housing 11 so as to be rotatable with respect to the fixed scroll member 21.

The fixed scroll member 21 is formed from a member in the shape of a disk provided so as to divide the interior of the first housing 11, and a swirl body 21*a* is provided on a surface on the rotating scroll member 22 side. In the radially middle part of the fixed scroll member 21, there is provided a cooling medium discharge hole 21*b* for discharging a cooling medium compressed in the compression section 20. A cooling medium discharge chamber 11*a* is provided between one end surface in the first housing 11 and the fixed scroll member 21 so that a cooling medium discharged from the cooling medium discharge port flows into the cooling medium discharge chamber 11*a*.

The rotating scroll member 22 is such that a swirl body 22*a* is provided on the surface thereof on the fixed scroll member 21 side, and to the surface on the opposite side, there is connected, via a driving bush 24, the side of one end of a driving shaft 23 for transmitting the torque of the motor 30.

The driving shaft 23 is provided so as to extend along the central axis of the second housing 12. The driving shaft 23 is provided in such a manner that a connection 23*a* to the driving bush 24 is eccentric from the rotation center of the driving shaft 23. Also, the driving shaft 23 is such that the side of one end thereof is rotatably supported by a center plate 25 provided between the compression section 20 and the motor 30 via a ball bearing 26 and the side of the other end thereof is rotatably supported by a bearing 12*a* provided on the side of the other end surface of the second housing 12 via a ball bearing 27. That is, the driving shaft 23 is rotated by the motor 30 and is adapted to cause the rotating scroll member 22 to rotate on a prescribed circular orbit.

The center plate 25 is provided so as to divide the space on the compression section 20 side and the space on the motor 30 side in the housing 10, and there is provided a communication hole for providing communication between the space on the compression section 20 side and the space on the motor 30 side. Also, the center plate 25 is provided with a flanged portion 25*a* extending in the circumferential direction of an outer circumferential surface so that the flanged portion 25*a* becomes sandwiched between the first housing 11 and the second housing 12.

The motor 30 has a rotor 31 formed from a permanent magnet fixed to the driving shaft 23, and a stator 32 which is provided so as to surround the rotor 31 and is fixed in the second housing 12.

The driving circuit section 40 is composed of an inverter circuit 41 having, on a substrate, power semiconductor elements 41*a* as a plurality of heat generating parts, a power circuit part 42, such as a smoothing capacitor and a noise filter, a control section 43 of a microcomputer configuration, and the like. The driving circuit section 40 is housed in the driving circuit housing chamber 13*c* and is fixed in the driving circuit housing chamber 13*c* by use of a molded resin 44.

The inverter circuit 41 is attached so as to be in contact with a wall surface of the driving circuit housing chamber 13*c* on the partition wall 13*b* side and as shown in FIG. 2, part thereof is positioned in the range of the partition wall 13*b* and the other portion thereof is positioned outside the range of the partition wall 13*b*. As a result of this, the plurality of power semiconductor elements 41*a* on the inverter circuit 41 are such that some of the power semiconductor elements 41*a* are positioned on the partition wall 13*b* and other power semiconductor elements 41*a* are positioned outside the range of the partition wall 13*b*. The inverter circuit 41 is provided with a temperature detection sensor 41*b*, such as a thermistor, in the vicinity of a power semiconductor element 41*a* whose distance from the partition wall 13*b* is longest among a plurality of power semiconductor elements 41*a*, i.e., a power semiconductor element 41*a* for which heat exchange with a cooling medium flowing into the cooling medium suction chamber 13*d* is difficult and in which the temperature becomes highest among the plurality of power semiconductor elements 41*a*.

This electric compressor is provided with a rotating position limiting mechanism 50, which is provided in order to limit the rotating position of the rotating scroll member 22 and is composed of a pin provided in the rotating scroll member 22 and a pin provided in the center plate 25 as well as a connecting member for connecting the pins together.

In the electric compressor configured as described above, when the driving shaft 23 is rotated by energizing the motor 30, in the compression section 20 the rotating scroll member 22 performs a rotating motion with respect to the fixed scroll member 21. As a result of this, a cooling medium which flows from the cooling medium suction port 13*a* into the housing 20 cools, via the partition wall 13*b* of the coding medium suction chamber 13*d*, each power semiconductor element 41*a* of the inverter circuit 41 of the driving circuit section 40, and cools the motor 30 by flowing through the second housing 12. The cooling medium flowing through the interior of the second housing 12 flows between the rotating scroll member 22 and the center plate 25 via the communication hole of the center plate 25, and flows into the compression section 20 after cooling the rotating position limiting mechanism 50. The cooling medium compressed in the compression section 20 flows from the cooling medium discharge hole 21*b* into the cooling medium discharge chamber 11*a*, and is discharged from the cooling medium discharge port.

During the operation of the electric compressor, the control section 43 detects temperatures in the vicinity of a prescribed power semiconductor element 41*a* by use of the temperature sensor 41*b* and if a temperature detected by the temperature sensor 41*b* is not less than a prescribed temperature, the control section 43 changes the number of revolutions of the motor by increasing or decreasing the number of revolutions of the motor or stops the motor.

As described above, according to the electric compressor of this embodiment, because a temperature sensor 41*d* is provided in the vicinity of the power semiconductor element 41*a* whose temperature becomes highest among the plurality of power semiconductor elements 41*a* and the control of the number of revolutions of the motor 30 is performed on the basis of temperatures detected by the temperature sensor 41*d*, it is possible to change the number of revolutions of the motor 30 on the basis of temperatures in the vicinity of the power semiconductor element 41*a* in a position under the worst temperature conditions, and it is possible to positively protect the inverter circuit 41 without the need for a plurality of temperature sensors 41*b*.

In the embodiment described above, the power semiconductor element 41*a* in a position at the longest distance from the partition wall 13*b* on the wall surface of the driving circuit housing chamber 13*c* on the partition wall 13*b* side was mentioned as the power semiconductor element 41*a* in a position under the worst temperature conditions. However, it is also possible to regard the power semiconductor element 41*a* having the longest distance from the wall surface of the partition wall 13*b* in the vertical direction as a position under the worst temperature conditions.

In the embodiment described above, the power semiconductor element 41*a* which is positioned outside the range of the partition wall 13*b* was mentioned as the power semiconductor element 41*a* in a position under the worst temperature conditions. However, when the temperature differs in the range of the partition wall 13*b*, a power semiconductor element 41*a* which is positioned on the side of a place where the temperature is highest in that range (for example, the downstream side of the direction in which a cooling medium of the cooling medium suction chamber 13*d* flows) may be regarded as a power semiconductor element 41*a* in a position under the worst temperature conditions.

DESCRIPTION OF SYMBOLS

10: Housing, 11: First housing, 12: Second housing, 13: Third housing, 13*b*: Partition wall, 13*c*: Driving circuit housing chamber, 13*d*: Cooling medium suction chamber, 20: Compression section, 30: Motor, 40: Driving circuit section, 41: Inverter circuit, 41*a*: Power semiconductor element, 41*b*: Temperature sensor, 43: Control section.

The invention claimed is:

1. An electric compressor comprising:

a compression section for compressing a cooling medium sucked into a housing;

a motor for driving the compression section;

a motor driving circuit for driving the motor, the motor driving circuit including an inverter circuit having a plurality of power semiconductor elements as a plurality of heat generating parts, a control section of a microcomputer configuration and a power circuit part having a smoothing capacitor and a noise filter;

a cooling medium suction chamber provided on the cooling medium inflow side in the housing;

a driving circuit housing chamber for housing the motor driving circuit;

a partition wall which is provided so as to partition the cooling medium suction chamber and the driving circuit housing chamber, and permits heat exchange between the cooling medium in the cooling medium suction chamber and the motor driving circuit in the driving circuit housing chamber; and a temperature sensor provided in the vicinity of the plurality of power semiconductor elements;

wherein the power semiconductor elements are disposed on a wall surface of the driving circuit housing chamber inside and outside a range of the partition wall, so that the power semiconductor elements generate different levels of heat;

the temperature sensor is provided in the vicinity of a power semiconductor element that generates the highest temperature; and the control section performs control of the number of revolutions of the motor on the basis of the highest temperatures detected by the temperature sensor.

2. The electric compressor according to claim 1, wherein the inverter circuit, the control section and the power circuit part are fixed in the driving circuit housing chamber by use of a molded resin.

3. An electric compressor comprising:

a compression section for compressing a cooling medium sucked into a housing;

a motor for driving the compression section;

a motor driving circuit for driving the motor, the motor driving circuit including an inverter circuit having a plurality of power semiconductor elements as a plurality of heat generating parts, a control section of a microcomputer configuration and a power circuit part having a smoothing capacitor and a noise filter;

a cooling medium suction chamber provided on the cooling medium inflow side in the housing;

a driving circuit housing chamber for housing the motor driving circuit;

a partition wall which is provided so as to partition the cooling medium suction chamber and the driving circuit housing chamber, and permits heat exchange between the cooling medium in the cooling medium suction chamber and the motor driving circuit in the driving circuit housing chamber; and a temperature sensor provided in the vicinity of the plurality of power semiconductor elements;

wherein the power semiconductor elements are disposed on a wall surface of the driving circuit housing chamber inside and outside a range of the partition wall, so that the power semiconductor elements generate different levels of heat, the power semiconductor elements disposed outside the range of the partition wall generating higher levels of heat than the power semiconductor elements disposed inside the range of the partition wall;

the temperature sensor is provided in the vicinity of a power semiconductor element that is disposed at a longest distance away from the range of the partition wall; and the control section performs control of the number of revolutions of the motor on the basis of the highest temperatures detected by the temperature sensor.

4. The electric compressor according to claim 3, wherein the inverter circuit, the control section and the power circuit part are fixed in the driving circuit housing chamber by use of a molded resin.

* * * * *